US005611646A

United States Patent [19]

Voss

[11] Patent Number: 5,611,646

[45] Date of Patent: Mar. 18, 1997

[54] SUPPORT PROP WITH INTEGRATED PRESSURE LIMITING VALVE AND NAILED PIPES

[75] Inventor: Richard Voss, Schwerte, Germany

[73] Assignee: Richard Voss Grubenausbau GmbH, Schwerte, Germany

[21] Appl. No.: 403,838

[22] PCT Filed: Jul. 9, 1994

[86] PCT No.: PCT/DE94/00792

§ 371 Date: Mar. 15, 1995

§ 102(e) Date: Mar. 15, 1995

[87] PCT Pub. No.: WO95/02748

PCT Pub. Date: Jan. 26, 1995

[30] Foreign Application Priority Data

Jul. 14, 1993 [DE] Germany ..... 43 23 462.3

[51] Int. Cl.[6] ..... E21D 15/44

[52] U.S. Cl. ..... 405/290; 91/170 MP; 91/432; 137/522; 251/63.4

[58] Field of Search ..... 405/288, 290, 405/294; 91/170 MP, 432; 137/522; 251/63.4

[56] References Cited

U.S. PATENT DOCUMENTS

| | | | |
|---|---|---|---|
| 718,694 | 1/1903 | Chapman | 137/505.18 |
| 2,333,522 | 11/1940 | Clifton | 137/491 |
| 2,621,631 | 12/1952 | Dowty | 60/468 |
| 2,625,174 | 1/1953 | Forde | 137/491 |
| 2,829,670 | 4/1958 | Nix | 137/628 |
| 3,174,410 | 3/1965 | Booth | 91/419 |
| 3,482,594 | 1/1967 | Simon | 137/538 |
| 3,613,716 | 10/1971 | Hoheisel | 137/491 |
| 3,756,558 | 9/1973 | Okui | 251/282 |
| 4,135,541 | 1/1979 | Lorimor | 137/116.3 |
| 4,215,715 | 8/1980 | Raskin | 137/505.13 |
| 4,252,476 | 2/1981 | Koppers et al. | 405/290 |
| 4,284,101 | 8/1981 | Weirich | 137/538 |
| 4,305,423 | 12/1981 | Adler | 137/505.13 |
| 4,530,373 | 7/1985 | Bork, Jr. | 137/516.29 |
| 4,597,410 | 7/1986 | Wilke | 137/491 |
| 4,716,928 | 1/1988 | Kussel | 137/494 |
| 4,724,857 | 2/1988 | Taylor | 137/67 |
| 4,727,902 | 3/1988 | Unterstein | 137/454.5 |
| 5,051,039 | 9/1991 | Heiliger | 405/290 |
| 5,168,895 | 12/1992 | Voss | 137/494 |
| 5,285,813 | 2/1994 | Quante | 137/494 |
| 5,297,901 | 3/1994 | Voss | 405/290 |
| 5,396,924 | 3/1995 | Voss | 37/491 |
| 5,400,817 | 3/1995 | Voss | 137/491 |
| 5,462,076 | 10/1995 | Voss | 137/454.5 |

FOREIGN PATENT DOCUMENTS

| | | |
|---|---|---|
| 226177 | 3/1963 | Austria . |
| 370501 | 4/1983 | Austria . |
| 1273471 | 9/1960 | France . |
| 2216435 | 8/1974 | France . |
| 1408064 | 12/1968 | Germany . |
| 7301728 | 1/1973 | Germany . |
| 2625299 | 12/1976 | Germany . |
| 2538760 | 2/1977 | Germany . |

(List continued on next page.)

OTHER PUBLICATIONS

"Grundlagen und Komponenten der Fluidtechnik Hydraulik", Der Hydraulik Trainer, Band 1, pp. 216–217 (undated).

*Primary Examiner*—David J. Bagnell
*Attorney, Agent, or Firm*—James Creighton Wray

[57] ABSTRACT

A compact support prop having a pressure limiting valve with a very high flow volume forming a prop head as a valve housing. The pressure limiting valve is integrated into the prop head. Thus, insertion speeds of more than 3 meters per second can be achieved. The drawing and filling valve consists of one or possibly two pilot-controlled check valves which can be easily attached to an outer side of the internal prop. It allows for a quick setting and drawing after removal of the released pressure medium. The released pressure medium flows off via the connection of the pilot-controlled check valve. The connection is provided as a setting gun connection and the released pressure medium can be returned to the inside by this connection.

13 Claims, 4 Drawing Sheets

FOREIGN PATENT DOCUMENTS

| | | |
|---|---|---|
| 1909338 | 7/1978 | Germany . |
| 2840008 | 10/1979 | Germany . |
| 3314837 | 12/1983 | Germany . |
| 8408072 | 3/1984 | Germany . |
| 2830891 | 1/1986 | Germany . |
| 3504878 | 8/1986 | Germany . |
| 3508986 | 6/1988 | Germany . |
| 3802992 | 8/1989 | Germany . |
| 8912529 | 2/1990 | Germany . |
| 3922894 | 2/1991 | Germany . |
| 3929094 | 4/1991 | Germany . |
| 4021622 | 8/1991 | Germany . |
| 4035874 | 1/1992 | Germany . |
| 9303544 | 3/1993 | Germany . |
| 9302339 | 5/1993 | Germany . |
| 4123610 | 4/1994 | Germany . |
| 116774 | 5/1961 | U.S.S.R. . |
| 507701 | 7/1974 | U.S.S.R. . |
| 1473267 | 5/1977 | United Kingdom . |
| 2076121 | 11/1981 | United Kingdom . |

21
22
13
27
12
20
11
17
18
40
43
15
39
38
19
37
16
26
10
24
36
25
35
29
1
14
28
2
26
31
30
32
27
8
9
33
26
4
5
3
6
7

SUPPORT PROP WITH INTEGRATED PRESSURE LIMITING VALVE AND NAILED PIPES

BACKGROUND OF THE INVENTION

The invention relates to a support prop for underground mining use in longwall and gallery with telescopic external and internal prop, and connected with the latter a crown head, collar ring and sole plate, as well as a pressure limiting valve integrated into the prop head and a filling and drawing valve positioned on the internal prop.

In underground mining and in tunnel construction support props, also called individual props, are used to secure cavities which were created by mining. Known support props are constructed as single or multiple telescope props and are preferably operated with a water-in-oil emulsion. This emulsion is pumped via pumps located outside the longwall or at some distance from the respective operating site by way of suitable hose lines to the respective support prop. The inside of the support prop is then connected by way of so-called setting guns with the pump and is accordingly filled and extended, and in this way is clamped between the topwall and footwall. In the known support props the external and internal props with their different diameters are welded both to the crown head and to the collar ring and the sole plate. Because mostly improved pipes are used today, i.e. strain-hardened pipes, the structure is negatively affected or even destroyed when the crown head, collar ring and sole plate are welded on, whereby an exact testing of these modified properties is not possible. In addition, the filling and drawing valve used becomes relatively complicated, whereby this filling and drawing valve as a rule is attached to the internal prop from the outside and is coupled with the pressure limiting valve, in order to enable the coupling of the individual functions setting, drawing and protecting against overload in this manner with the integrated valve. These valves, particularly the pressure limiting valve, exhibit a relatively small flow volume, resulting thus in a too low insertion speed in cases of actual overloads. For this reason, high volume pressure limiting valves integrated in the prop head (DE-OS 40 35 874.7) have been created, in which relatively high volumes of up to 1,000 l per minute can be achieved. But the disadvantage here is that they still require the relatively complicated setting and drawing valve which is attached to the outside of the internal prop.

SUMMARY OF THE INVENTION

The invention is thus based on the task of designing a support prop consisting of strain-hardened pipes in such a way that the improvement is preserved during processing, and that a safe and quick setting and drawing with high insertion speed is ensured.

According to the invention the task is solved in that external prop, sole plate, internal prop and crown head are nailed, that the internal prop and the piston moving in the external prop are equipped with corresponding screw threads, and that the filling and drawing valve is constructed as a pilot controlled check valve with double setting gun connection.

With a support prop constructed in this manner, it is first advantageous to work with shear wires in order to connect the individual prop parts effectively and permanently with each other. These shear wires are inserted into appropriate bores or grooves, thus also reducing production expenditure.

But the special advantage is that the pipe improvement is preserved, since the work is performed essentially without increased temperatures. Another advantage is that the already known separation of filling and drawing valve on the one side and the pressure limiting valve on the other side makes it possible to realize a pressure limiting valve with a very high flow volume. Due to the pressure to be set and the given conditions, insertion speeds of 3 meters per second and more can be achieved; for this reason such a valve can be considered suitable for rock bursts. And finally, the filling and drawing valve has been simplified so that the filling and drawing process is facilitated and, in particular, it is now possible to catch pressure medium released during drawing and discharge it via the corresponding hose lines for subsequent recovery. This results in a much smaller environmental burden and is also an advantage in terms of operating technology, since it is now no longer necessary to supply the supply pumps almost continuously with new emulsion. Overall, this creates a support prop which optimally fulfills operational and other requirements.

According to one useful design of the invention it is provided that the piston has a nailed piston head made of aluminum which cooperates with the seal towards the inside wall of the external prop, and that the prop foot which must be connected to the sole plate is also made of aluminum. The aluminum parts used are located inside the support prop, so that they can be considered harmless according to standard German regulations. But since they are parts which are not insignificant with respect to volume, the use of aluminum parts clearly reduces the total weight of the support prop. The use of a corresponding piston head also advantageously creates a material combination in the friction area between external and internal prop which leads to an expectation of much lower friction. This results in long useful lives and favorable operating conditions.

The described favorable friction between the piston head and inside wall of the external prop can even be more improved if, as provided in the invention, the seal is arranged on the end of the piston head facing away from the prop foot. In this way the piston head almost floats on a corresponding water film so that the movement of the piston head is not only favorable in terms of friction, but this also results in an advantageously uniform movement.

In the described design, the prop has an integrated recuperating spring whose attachment at the prop foot is facilitated by the fact that the prop foot has a threaded connection with a hook receptacle. Into the prop foot, which after all consists of aluminum, a threaded connection of suitable steel or similar material can be inserted; and the spring then can be hung onto this threaded connection without risk of an overload, in particular a break. The making of the connection is also facilitated by this; in particular, the threaded connection is provided with a hexagon socket, permitting standard wrenches to be used.

While the piston head can be produced of aluminum which has a favorable effect on friction, the piston itself is made of steel, in particular of strain-hardened steel. To prevent unnecessary frictions here, the invention provides that the piston head has a larger diameter which is adapted to the inside diameter of the external prop, while the piston is shaped so as to leave a ring channel between the external prop and the outside wall of the piston. In the corresponding design of the support prop this ring channel is connected to the outside air, permitting an air compensation during the extension of the support prop or during the drawing. In the described design of the support prop, a recuperating spring is integrated into the support prop, a fact already pointed out above. Such a recuperating spring may be left off, and instead a hydraulic drawing may be accomplished if, as provided in the invention, the ring channel is constructed so as to extend to the collar ring, which is sealed above the ring channel against the internal prop by means of a sealing ring and has a pilot-controlled check valve which is connected via a bore to the ring channel. This makes it possible to introduce pressure fluid for the drawing through the pilot-controlled check valve and to insert the prop fully hydraulically when the first check valve is opened or unblocked. Expenditure for this is relatively low.

To be able to forego a separate influencing of the two check valves during hydraulic drawing, the invention provides that the pilot-controlled check valve at the collar ring is interconnected via hoses with the pilot-controlled check valve which functions as filling and drawing valve and thus can be unblocked respectively with control pressure fluid. This makes it possible, e.g. during the drawing in, that the pilot-controlled check valve that is associated with the collar ring is acted on and thus unblocks the pilot-controlled check valve which simultaneously functions as a filling and drawing valve in such a way that the fluid pressed from the prop inside is also able to exit and can be removed via the hose. Reversely, the pilot-controlled check valve associated with the collar ring is unblocked during the filling or setting of the support prop, so that the fluid standing in the ring chamber can flow out and the support prop can be easily extended.

In order to ensure the necessary seal in the piston head area, it is provided that in addition to the seal at the top edge of the piston head there is also a groove with a second seal at the bottom edge. This makes it possible to ensure effective sealing in both directions of the piston head. It is hereby provided that both the seal at the top edge and the second seal are constructed as a compact groove ring, so that the respective form and length of these seals prevents a fluttering, tilting, etc., when the valve responds, especially if an overload occurs.

In the above described design of the seal at the top and bottom edge of the piston head it is still possible to ensure a uniform lubrication if, as provided in the invention, a recess is provided in the piston head between the seal at the top edge and the second seal, in which recess a sealing band of Teflon is located. This Teflon band advantageously ensures a uniform movement of the piston head and thus of the entire internal prop.

The useful design of the pilot-controlled check valves has already been discussed briefly. These described advantageous functions are fulfilled in particular if the pilot-controlled check valves possess a three-part valve housing, inside which is arranged a valve piston which is able to move against the force of a valve spring and has a tappet and control piston, whereby the sealing surface of the valve piston seals the valve chamber connected with the prop inside against the intermediate tappet chamber, and the control piston seals the intermediate tappet chamber against the control piston back chamber, and that the intermediate tappet chamber is connected to one of the setting gun connections, and the control piston back chamber is connected to the other setting gun connection. This makes it possible to unblock the check valve easily and practically, so that during the drawing of the support prop only the control pressure must be supplied in order to move the control piston from the control piston back chamber in such a way that the control piston is lifted from its sealing surface and the pressure medium is able to flow out of the prop inside. The pressure medium hereby flows back the same way over which it was previously pressed via the setting gun and the pump into the prop inside, thus realizing not only a simple construction of the pilot-controlled check valve, but also ensuring that the released pressure medium is removed safely into the return or recovery area.

The force of the valve spring of the pressure limiting valve is achieved by moving a adjusting plate located in the prop head. The known adjusting plates have a hexagonal socket inserted here, whose production is somewhat complicated. To facilitate this, it is provided that the adjusting plate of the pressure limiting valve, which is arranged in a rotatable manner in the prop head, is provided with axial bores arranged off-set to the plate center. This makes it possible to set the valve using a relatively simple tool in such a way that the predefined response pressure is safely maintained.

The invention is characterized in particular in that it creates a support prop composed of strain-hardened pipes which are not being influenced during processing, so that the improvement is preserved. Based on these high-quality props, operation may take place at 420 bar. The corresponding support props are characterized by a setting load of 40 [metric] tons. The pressure limiting valve integrated into the support prop and the simplified filling and drawing valve make it possible to achieve insertion speeds of 3 meters per seconds, so that such support props are even suitable for absorbing the effects of rock bursts. The special design of the filling and drawing valve by way of pilot-controlled check valves makes it possible to catch pressure medium released during drawing and to return it to the cycle. The special design also enables a quick and safe setting and a quick and safe drawing.

Other details and advantages of the subject matter of the invention are found in the following description of the corresponding drawing which shows a preferred embodiment, including the necessary details and individual parts. In the drawing:

DETAILED DESCRIPTION OF THE PREFERRED EMBODIMENTS

Figure 1:
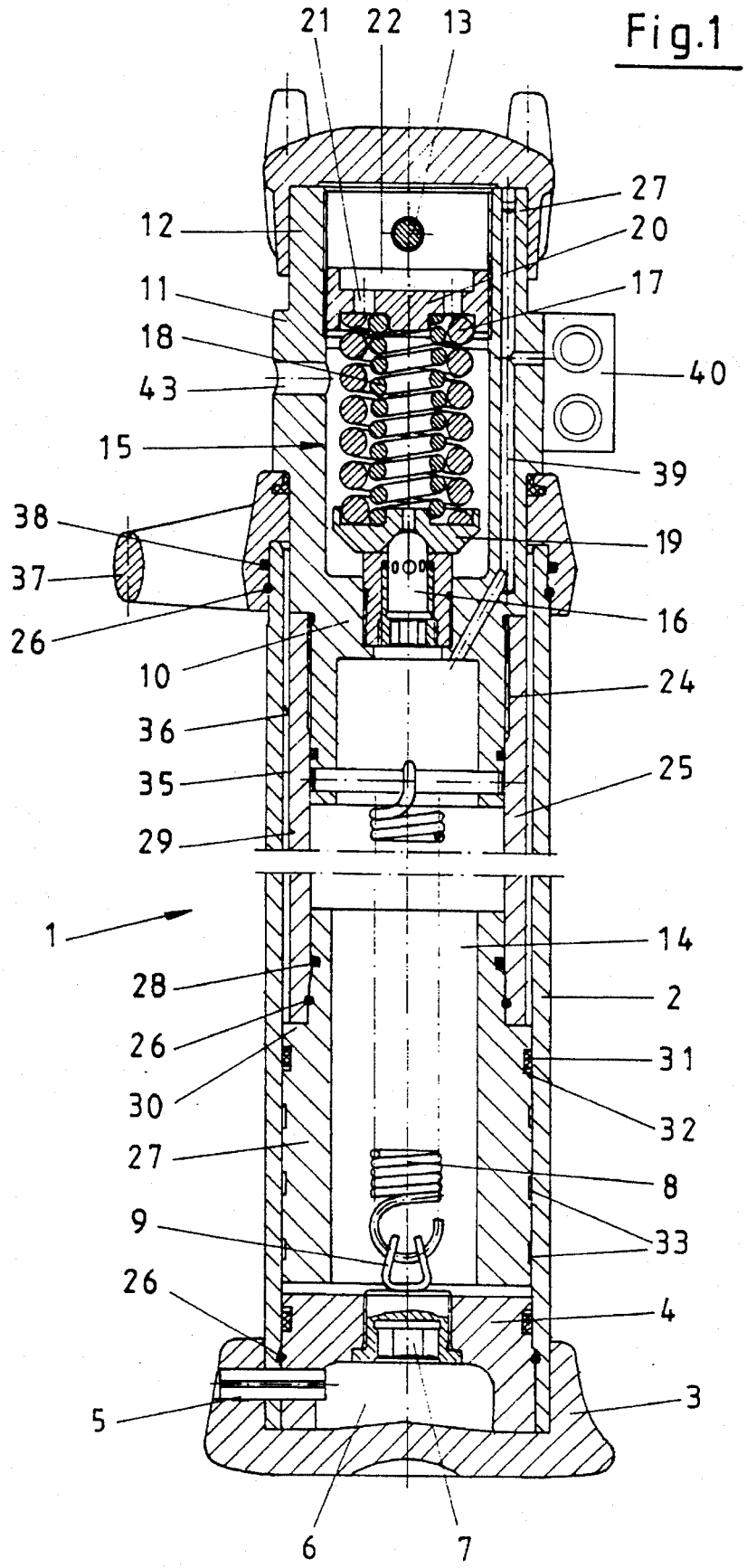
FIG. 1 shows a longitudinal section of a support prop, with suggested filling and drawing valve.

The support prop 1 shown in FIG. 1 consists of the exterior prop 2, the sole plate 3 connected to it by way of shear wires, and the prop foot 4, as well as of internal prop 10. The prop foot 4 is integrated into the external prop 2 and is connected to it by way of shear wires. In addition, both the sole plate 3 and the prop foot 4 are connected to the external prop 2 by way of splints 5. These splints 5 simply can be driven into the hollow space 6 when the sole plate 3 is loosened, so that they can be reused again.

The prop foot 4 contains a threaded connection 7 which has a hook receptacle 9 to connect the recuperating spring 8. This threaded connection consists e.g. of steel, while the remaining prop foot 4 consists of aluminum, resulting in a corresponding weight reduction.

The prop head 11 is connected to the crown head 12, whereby here also splints 13 can be used for the connection.

In order to be able to reduce the pressure in the prop inside 14 when a sudden overload occurs, a pressure limiting valve is integrated into the prop head 11. This pressure limiting valve 15 possesses a valve piston 16 with a relatively large diameter, and corresponding axial and radial bores, so that large volumes of pressure fluid are able to flow off towards the exit bore 43 if the pressure limiting valve responds. The corresponding response pressure is predefined by the two valve springs 17, 18 which are supported both on the spring plate 19 and on the adjusting plate 20. The adjusting plate 20 is arranged so as to be movable in the prop head 11 by way of a screw thread, whereby this can be accomplished with corresponding axial bores 21 extending from a disk-shaped recess 22 towards the valve springs 17, 18. In this manner the response point of the pressure limiting valve can be exactly predefined using a relatively simple tool.

All essential parts of the support prop 1 are interconnected via shear wires 26. Only between the piston 25 and the internal prop 10 a screw thread 24 has been provided, since use of a shear wire would only be possible at great expenditure, if at all.

The piston head 27, which itself is connected via a shear wire 26 to the piston 25, consists of aluminum. This provides a good material combination with low friction. The pressure fluid is unable to penetrate between the inside wall 29 of the external prop 2 and the corresponding outside wall of the piston head 27, since a seal 31 has been provided there at the end 30 facing away from the sole plate 3. This arrangement of the seal 31 in the groove 32 at this end 30 has the advantage that the entire piston head 27 moves on a water film, thus further minimizing any potential friction. The empty grooves 33 promote the formation and preservation of the water film. The prop inside 14 is sealed against this area with the seal 28.

While the piston head 27 hugs the inside wall 29 of the external prop 2 as closely as possible, a ring channel 35 is constructed in the area of the piston 25 between its outside wall 36 and the inside wall 29 of the external prop 2. This ring channel 35 extends up to the collar ring 37, whereby here a sealing ring 38 sealing this area is provided. Independently from this, the ring channel 35 must be connected to the outside wall in such a way that during the extension and retraction of the internal prop 10 no pressure cushion can build up here in the ring channel 35.

Laterally at the internal prop 10 the filling and drawing valve 40 which is connected via a connecting channel 39 to the prop inside 14 has been provided. This filling and drawing prop 40 is constructed as a pilot-controlled check valve 41, whereby details will be explained below. The check valve 41 is provided with two setting gun connections 42 and 53. It possesses a stable valve housing.

Figure 2:
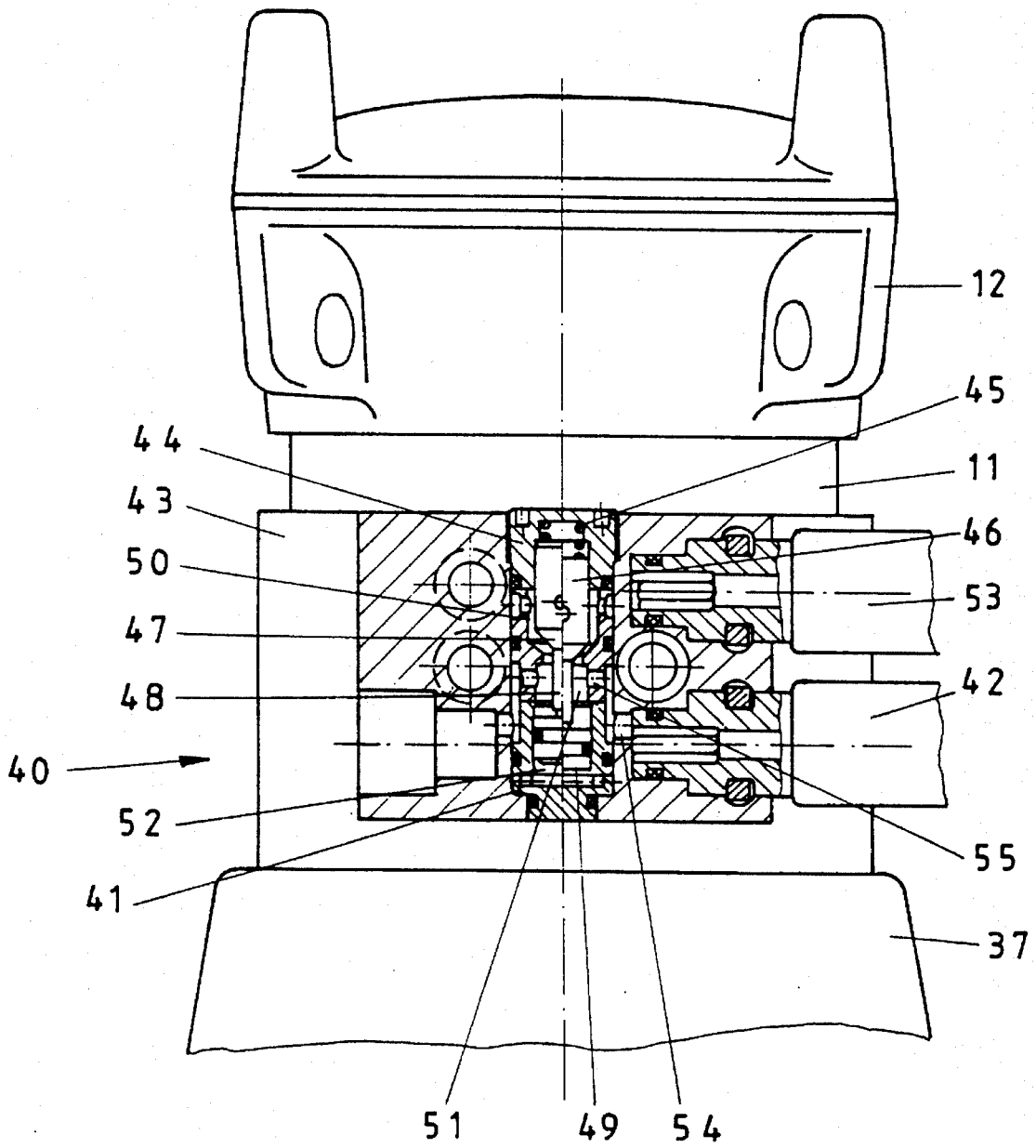
FIG. 2 shows an enlarged portrayal of a section of the filling and drawing valve.

The pilot-controlled check valve is explained in more detail in FIG. 2. A valve piston 46 that can be moved against the force of valve spring 45 is arranged inside the stable valve housing 44. This valve piston 46 is provided with a sealing surface 47 constructed so as to correspond to that of the valve housing 44, and with a long tappet 48, at the end of which a control piston 49 is arranged. The inside of the valve housing 44 is divided into three partial chambers, i.e. the valve chamber 50, the intermediate tappet chamber 51, and the control piston back chamber 52.

During the filling or setting of the support prop 1, the setting gun connection 42 is connected to the pump. The pressure fluid then flows via this setting gun connection 42 into the respective bores 54, 55 in the intermediate tappet chamber 51. The valve piston 46 is lifted from the sealing seat, i.e. the sealing surface 47, and the pressure fluid is able to flow into the valve chamber 50, and from here via a bore that is not shown into the prop inside 14.

If the support prop is supposed to be drawn in again, a control pressure is transmitted via a bore not shown here onto the control piston back chamber by way of the same setting gun and setting gun connection 53. The control piston 49 is moved accordingly and in this way lifts the valve piston 46 from the sealing surface 47 by way of the tappet 48, so that pressure fluid is able to flow in the reverse manner as described above through the unblocked check valve 41 from the prop inside 14, i.e. via setting gun connection 42. This setting gun connection is connected pressureless via a hose with a container, which is not shown here, so that the pressure fluid flows off accordingly, is caught in this container, and is then returned into the cycle.

Figure 3:
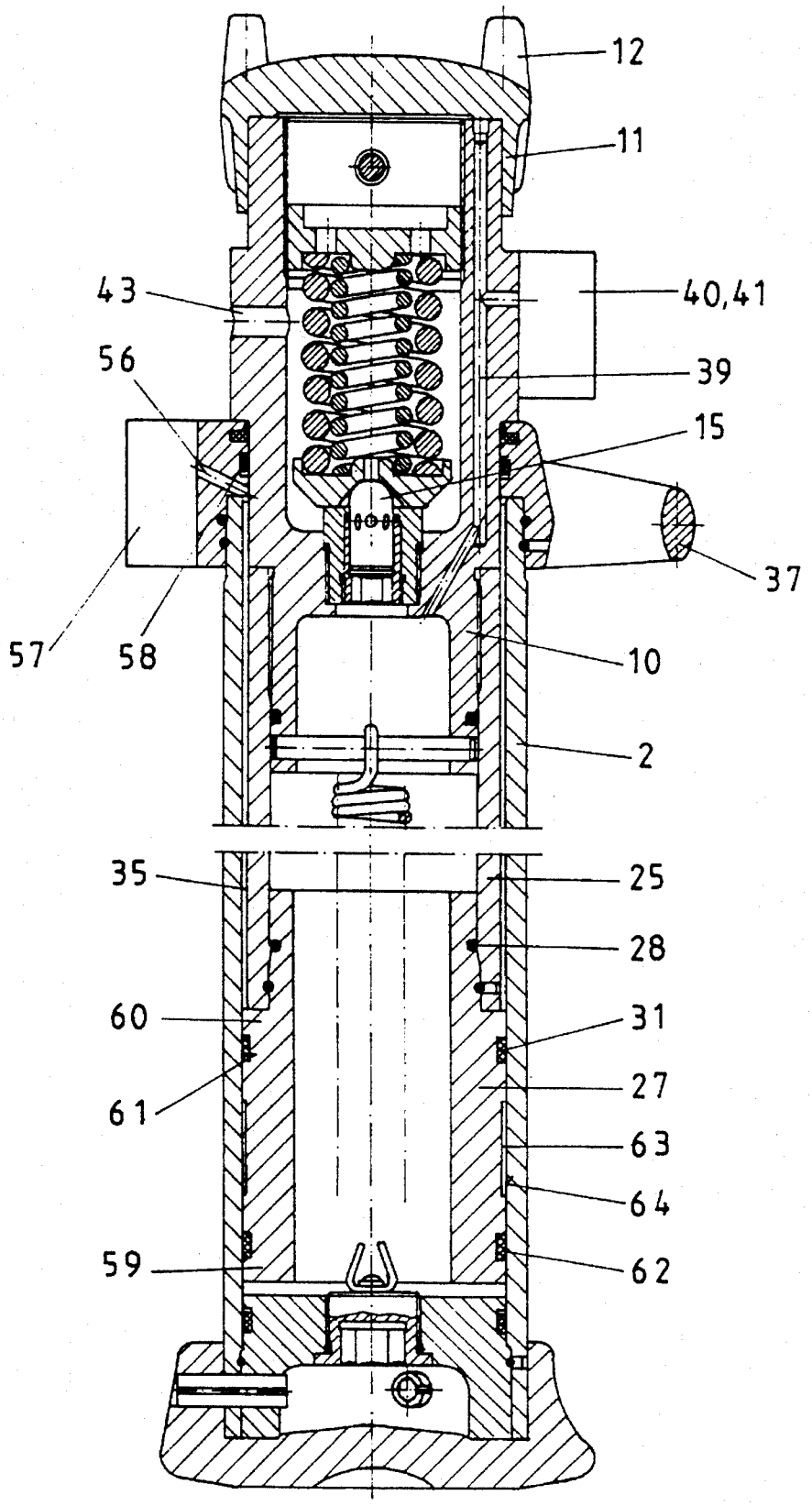
FIG. 3 shows a longitudinal section of the support prop intended for hydraulic drawing.
Figure 4:
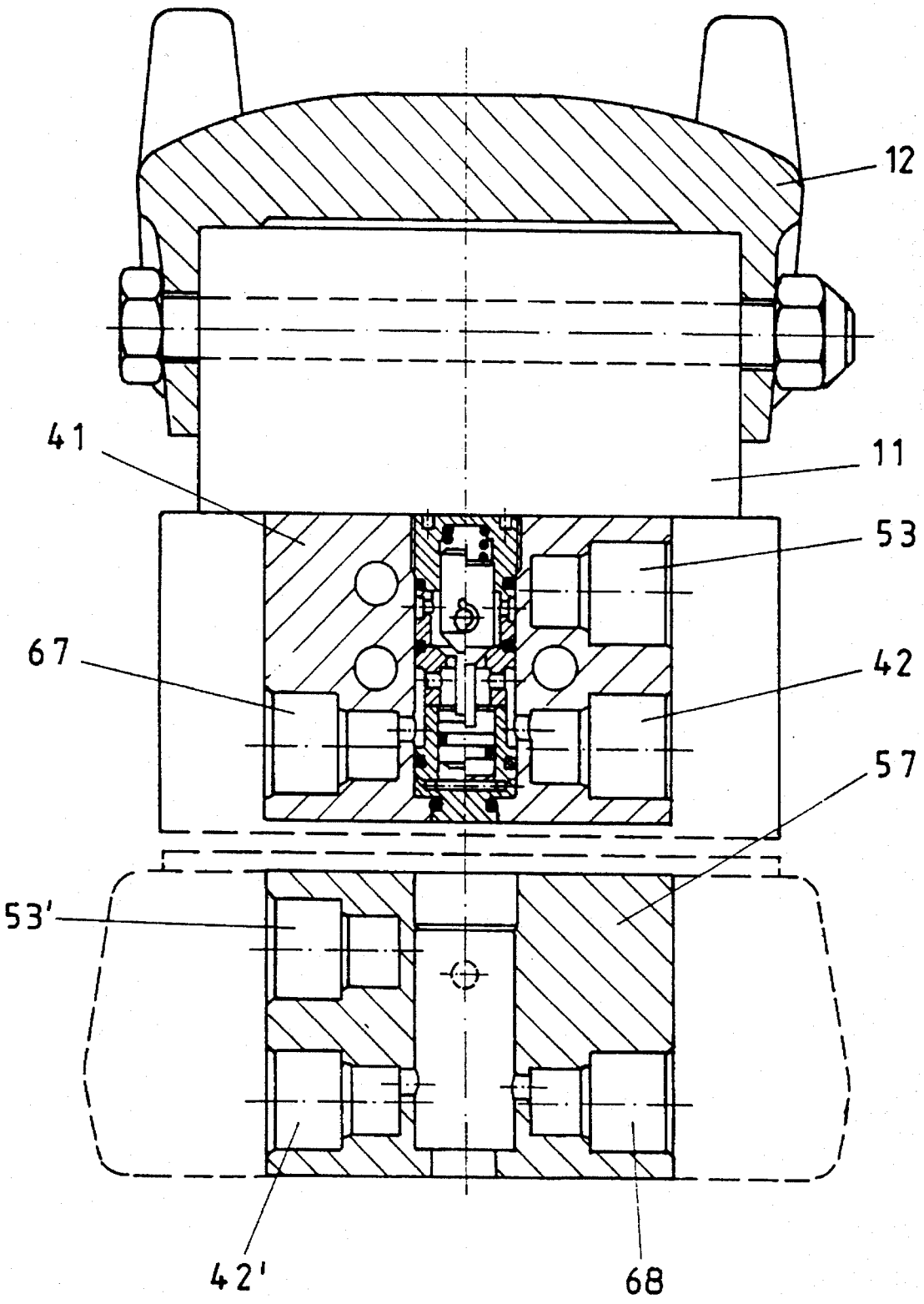
FIG. 4 shows both of the pilot-controlled check valves necessary for the hydraulic drawing.

FIG. 3 shows a support prop 1 in which the drawing in takes place hydraulically. For this purpose the ring channel 35 is connected between external prop 2 and internal prop 10 or piston 25 via a connecting bore 56 to a second pilot-controlled check valve 57. In this way pressure fluid can be forced via this pilot-controlled check valve 57 into the ring channel 35, so that the piston head 27 is pressed or pushed towards the prop foot 4. This area is also effectively sealed towards the top with an additional sealing ring 58.

In the version shown in FIG. 3, the prop interior chamber or prop inside 14 is sealed with two seals, namely with the already mentioned ring or seal 31 associated with the top edge 60, and also with the second seal 62 which is constructed inside a groove 61 at the bottom end 59 of the piston head 27. To ensure the necessary and desired low friction in this case also, the piston head 27 is provided with a recess, in which a Teflon (polytetrafluoroethylene) sealing band 64 is arranged. The two seals 62 and 31 are constructed as a compact groove ring, thus preventing vibrating and tilting when the piston head 27 is moved or, possibly, moved very rapidly.

The support prop design shown in FIG. 3 also ensures a removal of the released pressure medium which prevents that the pressure fluids inside the prop interfere with each other. For this purpose the two pilot-controlled check valves 41, 57 are interconnected via hoses, i.e. crosswise. As a result, in the case when pressure fluid for filling is supplied via the setting gun connection 42, pressure fluid is, via the opposing second connection 67 and the hose connected there, also supplied to the second setting gun connection 53' of the second check valve 57. This causes the second check valve 57 to unblock, and the pressure fluid standing in the ring channel 35 is able to flow off via the unblocked check valve 57 without interfering with the setting process of the support prop 1.

Reversely, pressure fluid is supplied via the setting gun connection 42' during the hydraulic drawing in of the support prop 1, so that pressure fluid is able to flow into the ring channel 35. At the same time, the first pilot-controlled check valve 41 is unblocked via the second connection 68 and the connecting hose for the control connection or the second setting gun connection 53. The pressure fluid held in the prop interior 14 is now able to flow off via the unblocked check valve 41, so that the drawing in process is accelerated by the pressure fluid in the ring channel.

All mentioned characteristics, including those found solely in the drawings, are considered to be essential to the invention, either by themselves or in combination.

I claim:

1. A support prop for underground mining comprising telescopic external and internal props, a crown head connected to the internal prop, a collar ring and a sole plate also connected to the internal prop, a pressure limiting valve integrated into the head, a filling and drawing valve positioned on the internal prop, wherein the external prop, the sole plate, the internal prop and the crown head are nailed, a piston movable within the external prop, the internal prop and the piston having a corresponding screw thread, and wherein the filling and drawing valve is a first pilot controlled check valve with two setting gun connections.

2. The support prop of claim 1, wherein the piston has a nailed piston head of aluminum material, further comprising a first seal provided on an inside wall of the external prop, the piston head cooperating with the seal, and a prop foot connected to the sole plate, the prop foot being of aluminum material.

3. The support prop of claim 2, wherein the first seal is provided on one end of the piston head in a direction facing away from the prop foot.

4. The support prop of claim 2, further comprising a hook receptacle in the external prop, and wherein the prop foot has a threaded connection with the hook receptacle.

5. The support prop of claim 2, wherein the piston head has a larger diameter a body of the piston and is adapted to the inside diameter of the external prop, and wherein the piston is shaped to leave a ring channel between the external prop and an outside wall of the piston.

6. The support prop of claim 5, further comprising a sealing ring for sealing the collar ring and the internal prop, and wherein the ring channel extends to the sealed collar ring, and a bore provided in the internal prop for connecting the pilot-control-led check valve to the ring channel.

7. The support prop of claim 5, further comprising plural hoses and a second pilot-controlled check valve, the first pilot-controlled check valve being interconnected via hoses with the pilot-controlled check valve at the collar ring.

8. The support prop of claim 7, further comprising the first and second pilot-controlled check valves having a three-part valve housing, a valve piston with a valve chamber provided in the housing, a valve spring in the housing such that the valve piston is movable against a force of the valve spring, a tappet having an intermediate tappet chamber provided in the housing, a control piston having a back chamber provided in the housing, wherein the intermediate tappet chamber is connected to one of the setting gun connections, and the control piston back chamber is connected to another setting gun connection, wherein a sealing surface of the valve piston seals the valve chamber and an inner side of the internal prop against the intermediate tappet chamber, and wherein the control piston seals the intermediate tappet chamber against the control piston back chamber.

9. The support prop of claim 2, further comprising a second seal and a groove on another end of the piston head.

10. The support prop of claim 9, further comprising a recess in the piston between the first and second seals, and a sealing band provided in the recess.

11. The support prop of claim 10, wherein the sealing band is of polytetrafluoroethylene.

12. The support prop of claim 9, wherein the first and second seals are formed as a compact groove ring.

13. The support prop of claim 6, further comprising an adjusting plate provided on the prop head, wherein the adjusting plate is rotatable in the prop head, and axial bores provided on the adjusting plate off-set from a center of the adjusting plate.

* * * * *